US006563369B1

(12) United States Patent
Comer et al.

(10) Patent No.: US 6,563,369 B1
(45) Date of Patent: May 13, 2003

(54) ACTIVE CURRENT MIRROR CIRCUIT

(75) Inventors: David J. Comer, Springville, UT (US); Aaron K. Martin, Hillsboro, OR (US); James E. Jaussi, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/106,565

(22) Filed: Mar. 26, 2002

(51) Int. Cl.[7] ..... G05F 1/10
(52) U.S. Cl. ..... 327/538; 327/361
(58) Field of Search ..... 327/355, 361, 327/530, 534, 538, 543

(56) References Cited

U.S. PATENT DOCUMENTS 6,297,672 B1 * 10/2001 Okayasu ..... 327/103

* cited by examiner

*Primary Examiner*—Jeffrey Zweizig
(74) *Attorney, Agent, or Firm*—Schwegman, Lundberg, Woessner & Kluth, P.A.

(57) ABSTRACT

A current summing circuit includes an active cascode pair of transistors having a source-drain junction connected to a summing node to receive an input current at the source-drain junction to output an output current at a source of a transistor of the active cascode pair of transistors.

31 Claims, 10 Drawing Sheets

ACTIVE CURRENT MIRROR CIRCUIT

FIELD

Embodiments of the present invention relate generally to integrated circuits, and in particular to integrated circuits with current summing circuits.

BACKGROUND

Some circuits sum two or more currents in certain analog applications. A typical summer uses an operational amplifier (op-amp) to sum currents. The op-amp usually has compensation circuits to avoid instability. These compensation circuits tend to limit the operating frequency of the op-amp. Thus, when a summer uses an op-amp to sum currents, the operation of the summer is limited by the operating frequency of the op-amp. Some applications operate at a frequency that is higher than the operating frequency the op-amp. Therefore, the summers that use an op-amp to sum currents would not be suitable.

For these and other reasons stated below, which will become apparent to those skilled in the art upon reading and understanding the present specification, there is a need for current summing circuits that operate at higher frequencies.

DESCRIPTION OF THE EMBODIMENTS

Figure 1:
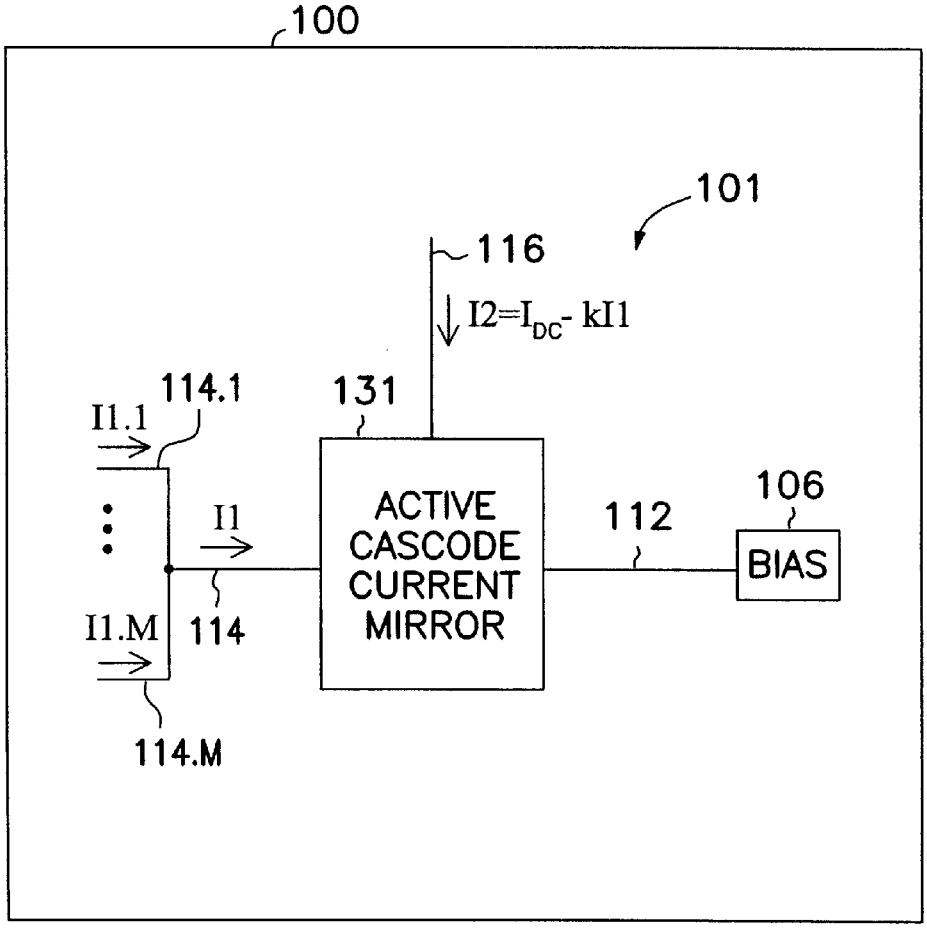
FIG. 1 shows an integrated circuit including a summing circuit.

The following detailed description of the embodiments refer to the accompanying drawings that show, by way of illustration, specific embodiments in which the invention may be practiced. In the drawings, like numerals describe substantially similar components throughout the several views. These embodiments are described in sufficient detail to enable those skilled in the art to practice the invention. Other embodiments may be used, and structural, logical, and electrical changes may be made without departing from the scope of the present invention. Moreover, the various embodiments of the invention, although different, are not necessarily mutually exclusive. For example, a particular feature, structure, or characteristic described in one embodiment may be included within other embodiments. Therefore, the following detailed description is not to be taken in a limiting sense, and the scope of the present invention is defined only by the appended claims, along with the full scope of equivalents to which such claims are entitled.

FIG. 1 shows an integrated circuit including a summing circuit. Integrated circuit 100 includes summing circuit 101. Summing circuit 101 includes an active cascode current mirror 131, a summing node 114, a plurality of input current paths 114.1 through 114.M, an output node 116, and a bias unit 106.

Input current paths 114.1 through 114.M connect to node 114. Each of input current paths 114.1 through 114.M has a current. For example, input current path 114.1 has current I1.1. Input current path 114.M has current I1.M. Bias unit 106 connects to active cascode current mirror 131 at bias node 112 to provide a bias voltage.

In embodiments represented by FIG. 1, currents I1.1 through I1.M are provided by one or more circuits that are external to summing circuit 101. Summing circuit 101 sums currents I1.1 through I1.M from nodes 114.1 through 114.M to produce an input current I1 at node 114. Thus, I1 equals the sum of I1.1 through I1.M. Active cascode current mirror 131 produces a current I2 at node 116.

The relationship between I2 and I1 is expressed by equation: $I2=I_{DC}-kI1$. $I_{DC}$ is a DC current generated by a bias voltage of bias unit 106 and k is a constant. Thus, when I1 is zero, I2 equals $I_{DC}$.

Figure 2:
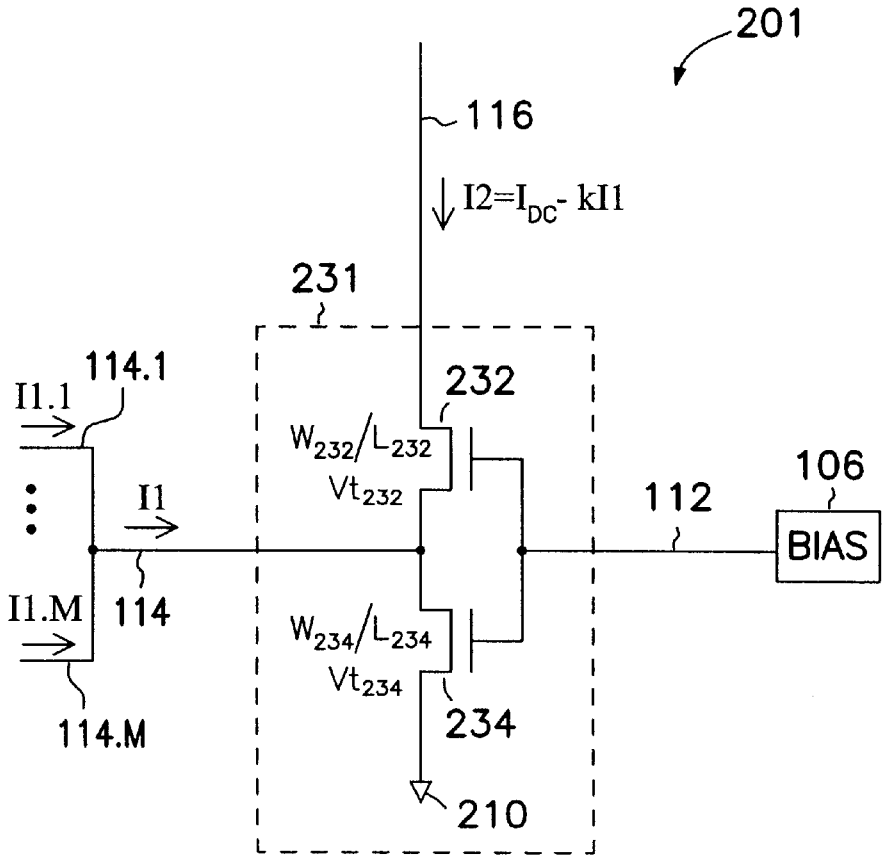
FIG. 2 shows a summing circuit including an active cascode current mirror.

FIG. 2 shows a summing circuit including an active cascode current mirror. Summing circuit 201 includes transistors 232 and 234, summing node 114, input current paths 114.1 through 114.M, an output node 116, and a bias unit 106. Transistors 232 and 234 connect in an active cascode fashion to form an active cascode current mirror 231 corresponding to current mirror 131 (FIG. 1). Other elements of FIG. 2 are similar to the elements of FIG. 1.

Transistors 232 and 234 form an active cascode pair of transistors in which their gates connect together at a common node to receive a common bias voltage. Transistor 232 has a drain connected to node 116, a source connected to node 114, and a gate connected to node 112. Transistor 234 has a drain connected to node 114, a source connected to node 210, and a gate connected to node 112. The source of transistor 232 connects to the drain of transistor 234 to form a source-drain junction of transistor pair 232 and 234. The source-drain junction connects to node 114 to receive the input current I1. Transistors 232 and 234 have a common gate at node 112 to receive a bias voltage provided by bias unit 106.

Each of transistors 232 and 234 has a channel width (W), a channel length (L), and a channel width to channel length (W/L) ratio. In FIG. 2, $W_{232}/L_{232}$ and $W_{234}/L_{234}$ indicate the channel width to channel length ratios of transistors 232 and 234 respectively. In some embodiments, $W_{232}/L_{232}$ is greater than W234/L234, and $W_{242}/L_{242}$ is greater than $W_{244}/L_{244}$. In other embodiments, $W_{232}/L_{232}$ is less than $W_{234}/L_{234}$, and $W_{242}/L_{242}$ is greater than $W_{244}/L_{244}$. In some embodiments, the channel length of transistor 234 ($L_{234}$) is longer than the channel length of transistor 232 ($L_{232}$). In other embodiments, the channel length of transistor 234 ($L_{234}$) is shorter than the channel length of transistor 232 ($L_{232}$).

Each of transistors 232 and 234 has a threshold voltage Vt. The threshold voltage of a transistor is primarily determined by the fabrication process, but is affected by the channel length of the transistor. In FIG. 2, $Vt_{232}$ and $Vt_{234}$ indicate the threshold voltages of transistors 232 and 234, respectively. In some embodiments, transistors 232 and 234 are constructed such that $Vt_{232}$ and $Vt_{234}$ are unequal.

In embodiments represented by FIG. 2, for proper scaling of the channel width to channel length ratio, transistor 232 operates in the non-linear (or active, or saturation) mode while transistor 234 operates in the linear (or triode) mode. With transistor 234 in the linear mode, a low impedance path to ground exists at nodes 114. Small voltages develop across the drain-to-source terminal of transistor 234 that is the input voltage to the source of transistor 232 node 114. The input current I1 at node 114 is mirrored by transistor 232 as I2 at node 116.

As shown in FIG. 2, $I2=I_{DC}-kI1$, where $I_{DC}$ is the DC current generated by the bias voltage of bias unit 106 and k is a function of a ratio between transistors 232 and 234. In some embodiments, k is proportional to the ratio of the size transistor 232 to the size of transistor 234. For example, k increases when the ratio of $W_{232}/L_{232}$ to $W_{234}/L_{234}$ increases.

Further, since summing circuit 201 has a low input impedance at node 114, different currents, such as currents I1.1 through I1.M, can be summed at node 114 to produce the input current, such as I1, without substantially changing the voltage at node 114. When the voltage at node 114 is unchanged, I1.1 through I1.M remain at their original values when they reach node 114. This allows summing circuit 201 to correctly sum the original values of I1.1 through I1.M to be I1.

Figure 3:
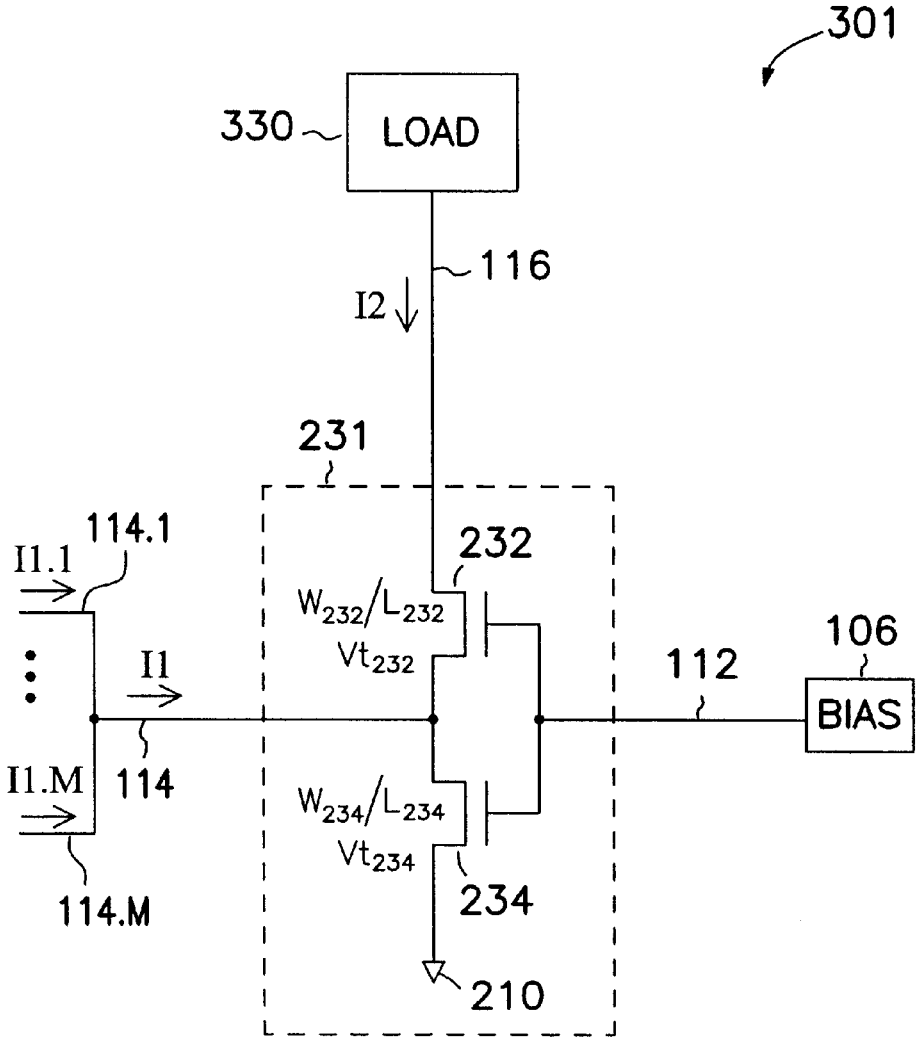
FIG. 3 shows a summing circuit having a load.

FIGS. 3 shows a summing circuit having a load. Summing circuit 301 includes a load 330 connected in series with a current path through active cascode pair of transistors 232 and 234. Summing circuit 300 includes elements similar to elements summing circuit 201 (FIG. 2).

Figure 4:
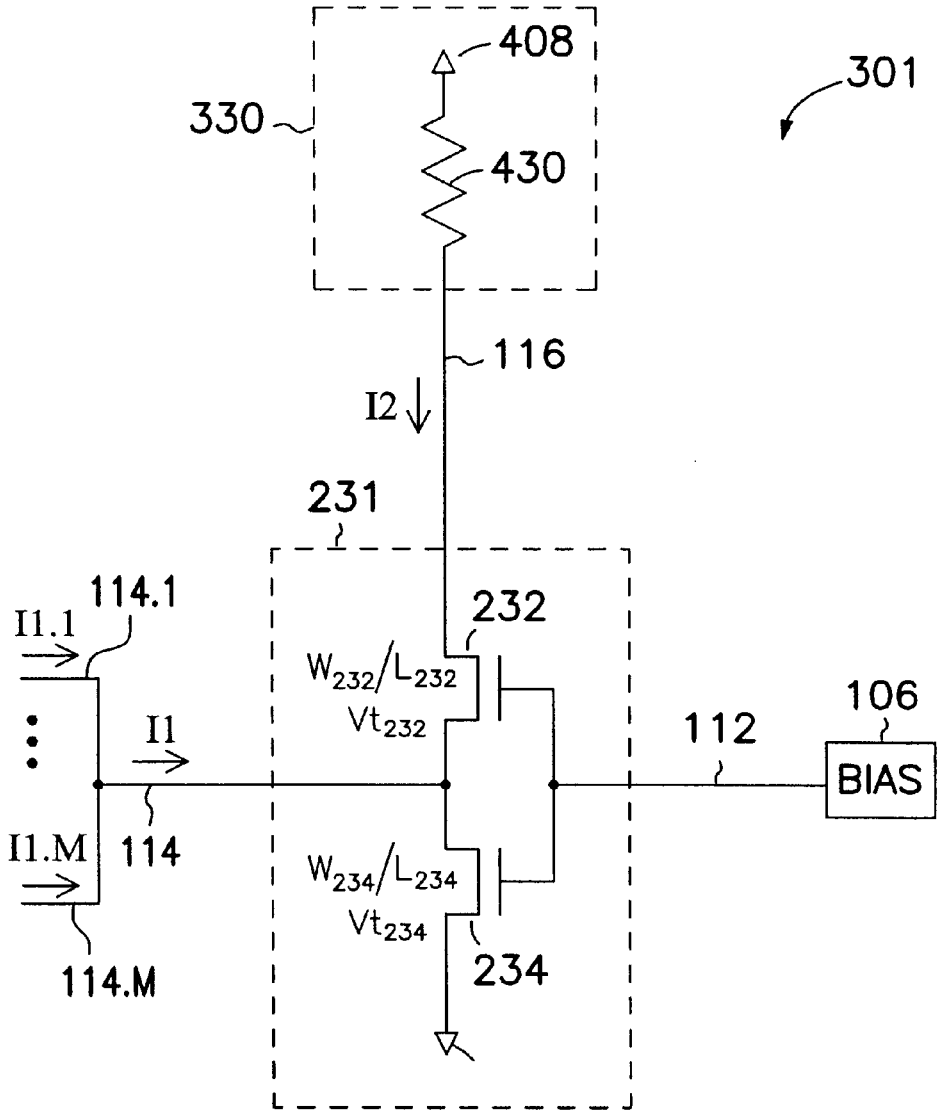
FIGS. 4–6 show summing circuits having different types of loads.
Figure 5:
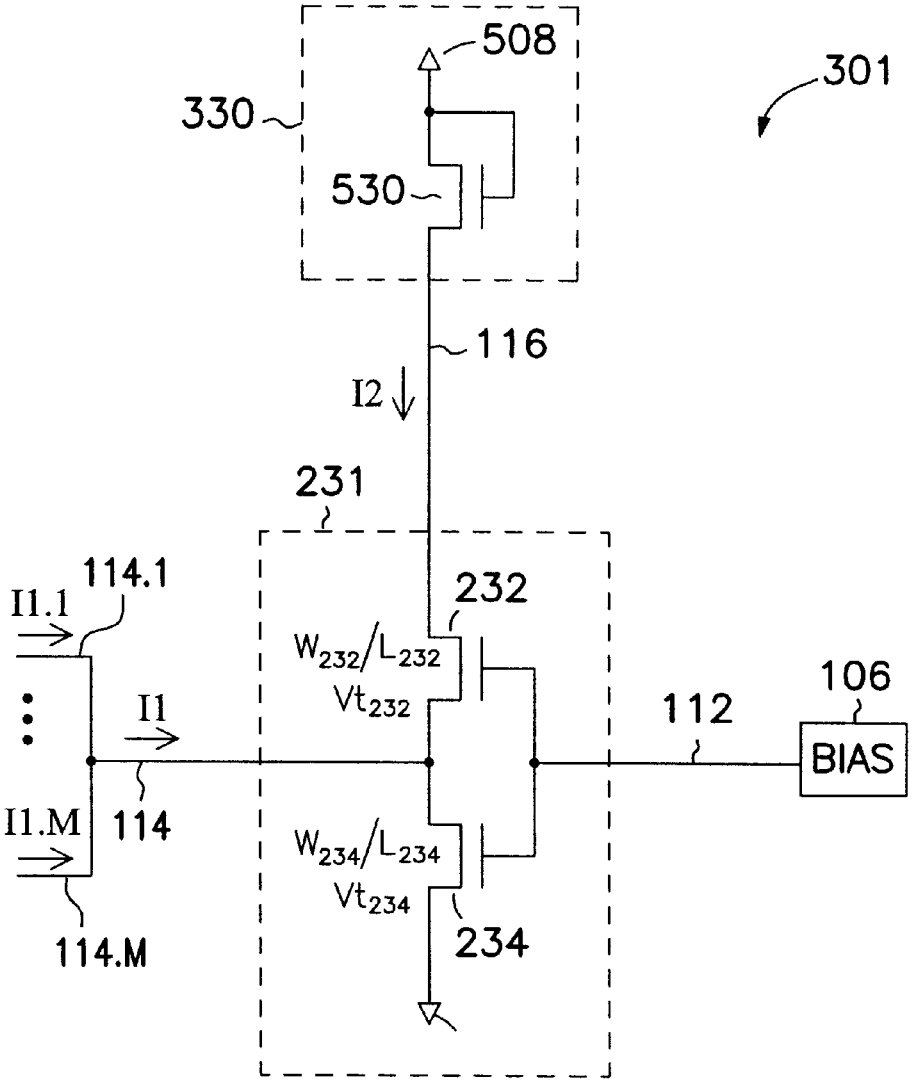
Figure 6:
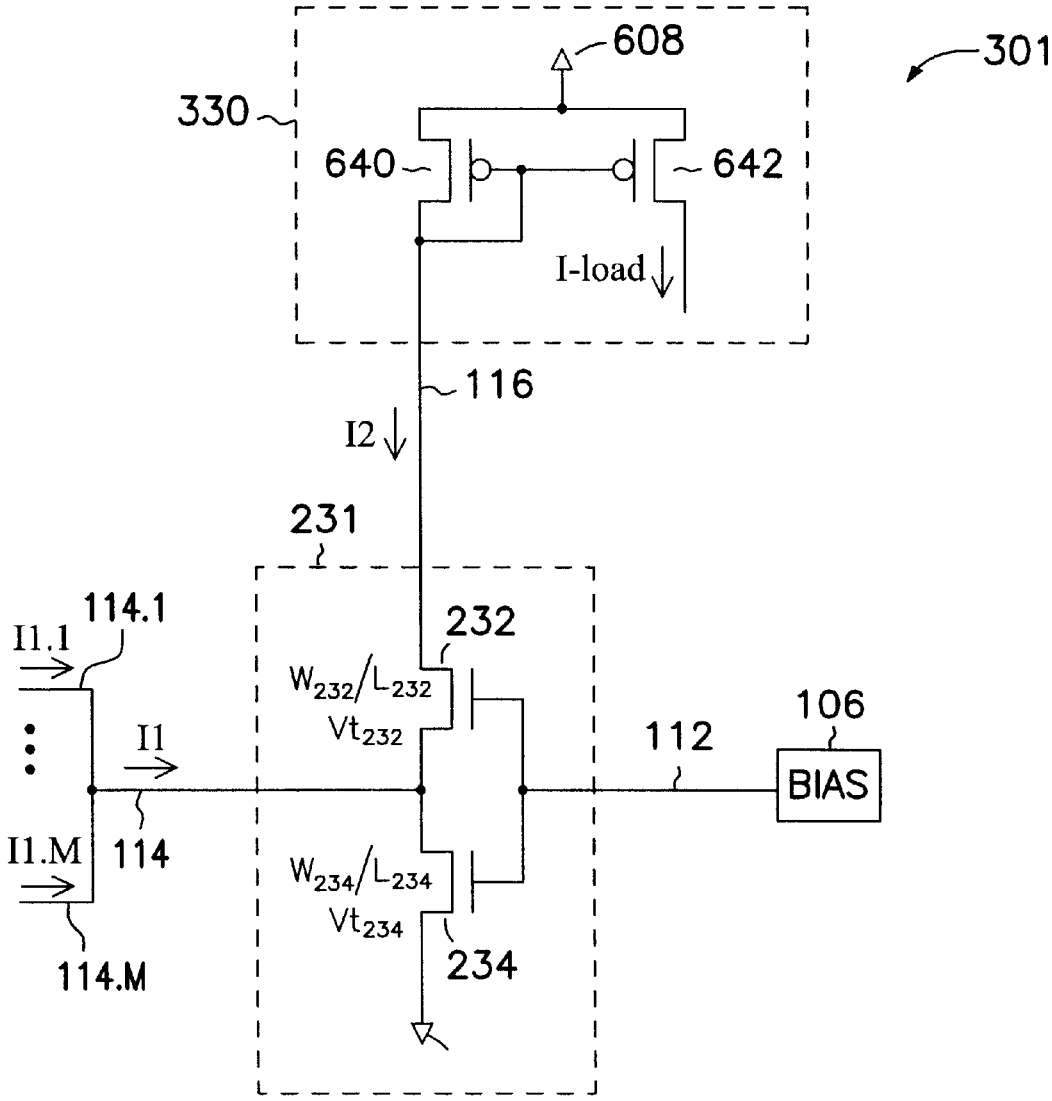

Figures show summing circuits of FIG. 3 having different types of loads. In FIG. 4, load 330 includes a resistor 430 connected between node 116 and a supply node 408. In FIG. 5, load 330 includes a diode connected transistor 530 connected between node 116 and a supply node 508. A diode-connected transistor has a gate connected to a drain, such that the gate-to-source voltage and the drain-to-source voltage are equal. In FIG. 6, load 330 includes a diode-connected current mirror formed by transistors 640 and 642. The diode-connected current mirror connects between node 116 and a supply node 608 to mirror current I2 to produce an output current I-load. In some embodiments, transistors 640 and 642 are matched and I-load equals I2.

Figure 7:
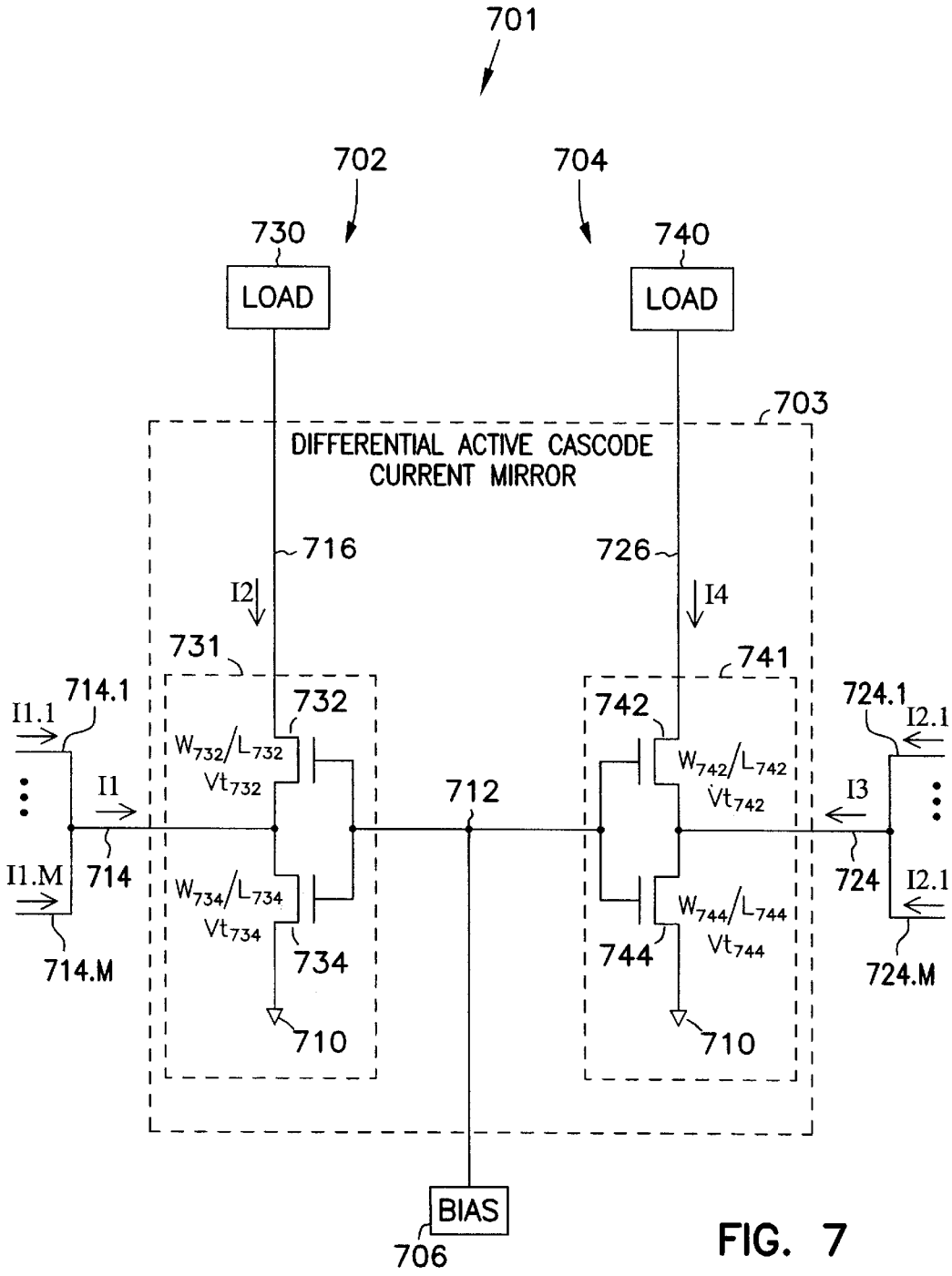
FIG. 7 shows a summing circuit with a differential active cascode current mirror.

FIG. 7 shows a summing circuit with a differential active cascode current mirror. Summing circuit 701 includes mirrored transistors 732 and 742, input transistors 734 and 744, load 730 and 740, a bias unit 706, summing nodes 714 and 724, output nodes 716 and 726, a plurality of input current paths 714.1 through 714.M, and a plurality of input current paths 724.1 through 724.M. Transistors 732 and 734 form an active cascode current mirror 731. Transistors 742 and 744 form another active cascode current mirror 741. Each of the active cascode current mirrors 731 and 741 corresponds to active cascode current mirror 231 (FIG. 2).

Active cascode current mirrors 731 and 741 form a differential active cascode current mirror 703. Each of the active cascode current mirrors 731 and 741 and a load form a branch. Branch 702 includes active cascode current mirrors 731 and load 730. Branch 704 includes active cascode current mirrors 741 and load 740. In some embodiments, each of the loads 730 and 740 includes an embodiment of a load represented by resistor 430, diode-connected transistor 530, or diode-connected current mirror 630 (FIGS. 4–6). Each of the load 730 and 740 includes other linear or nonlinear load in alternative embodiments of the invention. Each of the branches 702 and 704 connects between a supply node 708 and another supply node 710. Branches 702 and 704 connect in parallel with each other. In some embodiments, supply node 708 has a higher potential than supply node 710. In other embodiments, supply node 710 has a ground potential.

Transistors 732 and 734 form an active cascode pair of transistors. Transistors 742 and 744 form another active cascode pair of transistors. The active cascode pairs of transistors of FIG. 7 connect in a similar fashion as transistors 232 and 234 (FIG. 2). The source of transistor 732 connects to the drain of transistor 734 to form a source-drain junction, which connects to node 714 to receive I1. The source of transistor 742 connects to the drain of transistor 744 to form a source-drain junction, which connects to node 724 to receive I3.

As shown in FIG. 7, transistors 732, 734, 742, and 744 have a common gate at a common bias node 712. Also shown in FIG. 7, load 730 connects in series with the current path of I3 flowing through active cascode pair of transistors 732 and 734. Load 740 connects in series with the current path of I4 through active cascode pair of transistors 742 and 744.

In embodiments represented by FIG. 7, all transistors are n-channel metal oxide semiconductor field effect transistors (NMOSFETs), also referred to as "NFETs" or "NMOS". In other embodiments, the transistors are p-channel metal oxide semiconductor field effect transistors (PMOSFETs), also referred to as "PFETs" or "PMOS". One of ordinary skill in the art will understand that many other types of transistors can be used in alternative embodiments of the present invention.

Each of transistors 732, 734, 742, and 744 has a channel width (W), a channel length (L), and a channel width to channel length (W/L) ratio. In FIG. 7, $W_{332}/3_{232}$, $W_{334}/L_{334}$, $W_{342}/L_{342}$, and $W_{344}/L_{344}$ indicate the channel width to channel length ratios of transistors 732, 734, 742, and 744, respectively. For proper scaling of the channel width to channel length ratio, transistors 732 and 742 operate in the non-linear (or active, or saturation) mode while transistors 734 and 744 operate in the linear (or triode) mode. With transistors 734 and 744 in the linear mode, a low impedance path to ground exists at nodes 714 and 724. Small voltages develop across the drain-to-source terminal of transistors 734 and 744 that are the input voltages to the sources of transistors 732 and 742 at nodes 714 and 724. The input currents I1 and I3 at nodes 714 and 724 are mirrored by transistors 732 and 742 to produce I2 and I4.

Bias unit 706 applies the same bias voltage at common bias node 712 to the gates of transistors 732, 734, 742, and 744 such that transistors 732 and 734 operate in different operating modes, and transistors 742 and 744 operate in different operating modes. For example, for a given bias voltage (or potential) at node 712, transistor 732 operates in an active mode while transistor 734 operates in a linear mode. Likewise, for the same given bias voltage transistor 742 operates in an active mode while transistor 744 operates in a linear mode.

In some embodiments, transistors in each of transistor pairs 730 and 740, 732 and 742, and 734 and 744 are matched. Thus, When I1 and I3 are both zero, each of the I2 and I4 is equal to the DC current caused by bias unit 706. When summing circuit 701 receives differential I1 and I3, I2 is a function of the DC current and a current generated by I1. I4 is the a function of the DC current and a current generated by I1. I2 is proportional to I1 and I4 is proportional to I3.

Figure 8:
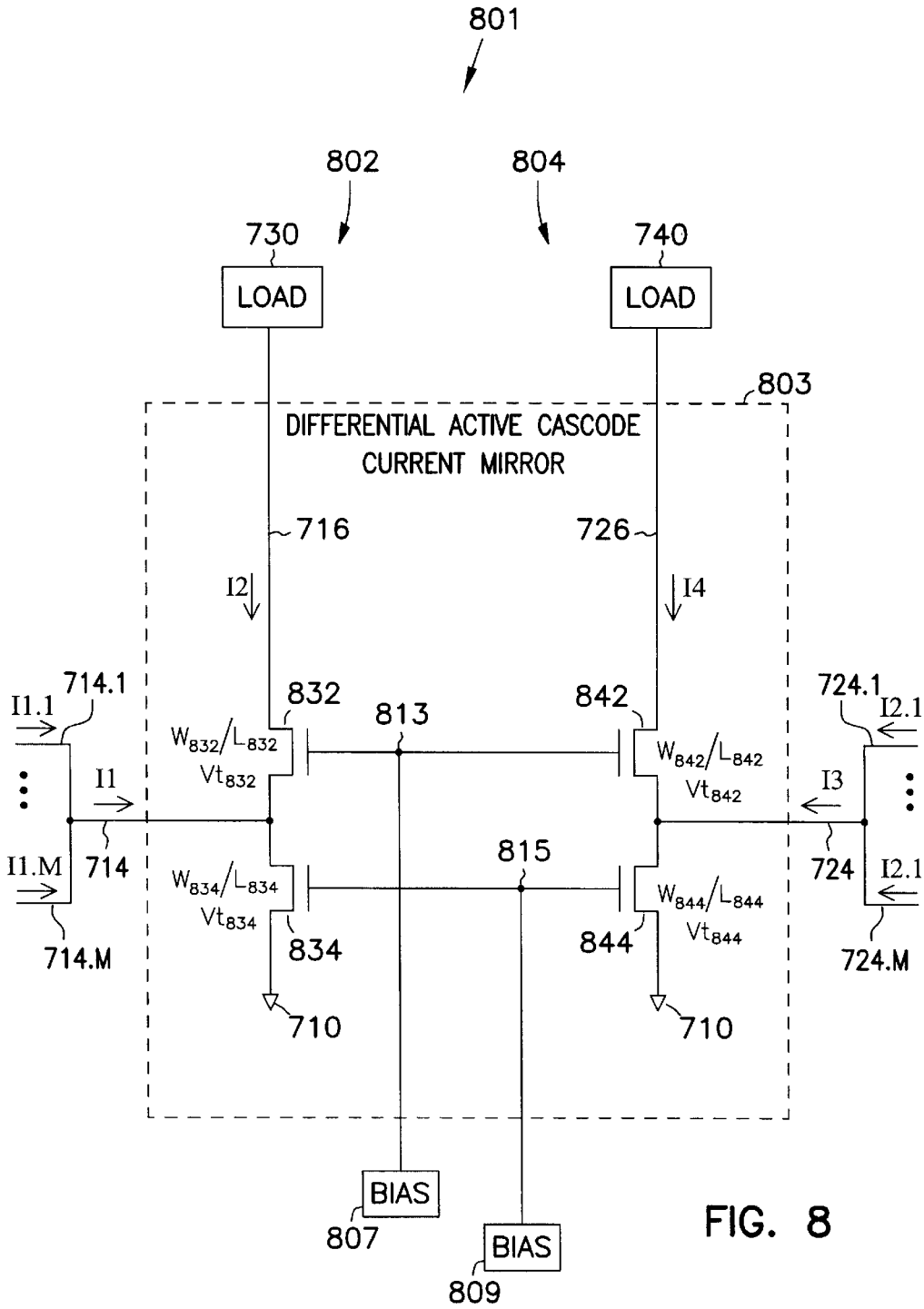
FIG. 8 shows a summing circuit having multiple bias units.

FIG. 8 shows a summing circuit having multiple bias units. Summing circuit 801 includes a differential active cascode current mirror 803 corresponding to differential active cascode current mirror 703 (FIG. 7), and elements that are similar to elements of summing circuit 701 (FIG. 7). However, summing circuit 801 includes multiple bias units 807 and 809. In some embodiments, bias units provide unequal bias voltages. Transistors 832 and 834, and load 730 form branch 802 corresponding to branch 702 (FIG. 7). Transistors 842, and 844, and load 740 form branch 804 corresponding to branch 704 (FIG. 7). In some embodiments, each of the loads 730 and 740 includes an embodiment of a load represented by resistor 430, diode-connected transistor 530, or diode-connected current mirror 630 (FIGS. 4–6).

Each of transistors 832, 834, 842, and 844 has a channel width (W), a channel length (L), and a channel width to channel length (W/L) ratio. In FIG. 8, $W_{332}/L_{332}$, $W_{334}/L_{334}$, $W_{342}/L_{342}$, and $W_{344}/L_{344}$ indicate the channel width to channel length ratios of transistors 832, 834, 842, and 844, respectively.

In embodiments represented by FIG. 8, each of the active cascode pairs of transistor 832 and 834, and 842 and 844 connects to multiple bias units. For example, active cascode pairs of transistor 832 and 834 connects to bias unit 807 at the gate of transistor 832, and connects to bias unit 809 at the gate of transistor 834. Active cascode pairs of transistor 842 and 844 connects to bias unit 807 at the gate of transistor 842, and connects to bias unit 809 at the gate of transistor 844. Transistors 832 and 842 have a common gate connects to node 813. Transistors 834 and 844 have a common gate connects to node 815.

With the configuration as shown in FIG. 8, the operating modes of transistors 832, 834, 842, and 844 can be influenced by different factors. For example, in some embodiments, transistors 832, 834, 842, and 844 can be constructed the same (or matched) such that these transistors have equal channel width to channel length ratios. In these embodiments, bias units 807 and 809 apply unequal bias voltages at a first bias node 813 and a second bias node 815 such that transistors 832 and 842 operate in a non-linear mode while transistors 834 and 844 operate in a linear mode. As another example, in other embodiments, transistors 832, 834, 842, and 844 have different constructions. In these embodiments, bias unit 807 and 809 can apply appropriate bias voltages on node 815 and 817 to influence the operating modes of transistors 832, 834, 842, and 844.

Figure 9:
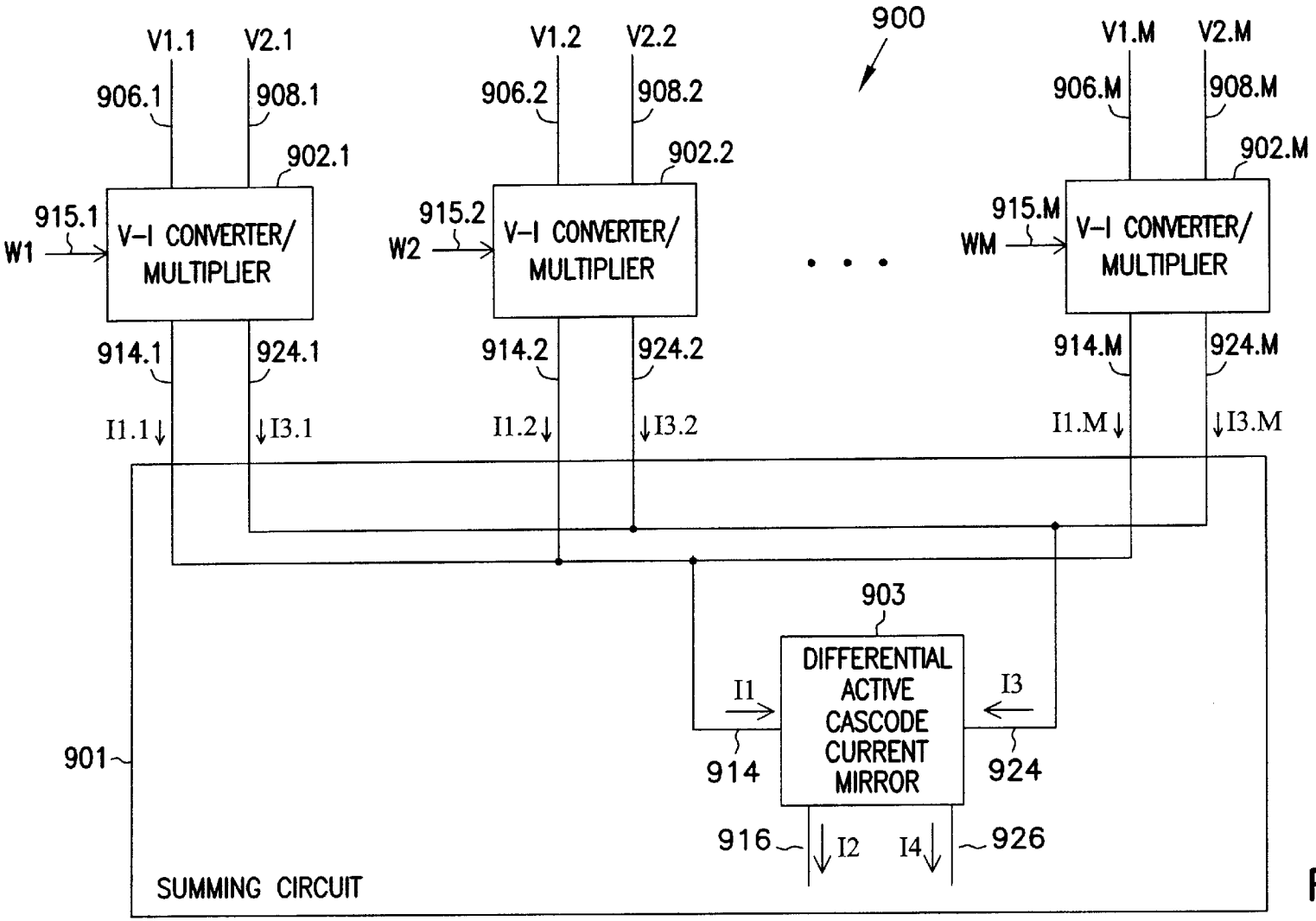
FIG. 9 shows a functional unit.

FIG. 9 shows a block diagram of a functional unit 900. Functional unit 900 includes a plurality of voltage-to-current (V-I) converter/multipliers 902.1, and 902.2 through 902.M, and a summing circuit 901. Each of the multipliers has multiplier input nodes, multiplier output nodes, and a weighting node. For example, V-I converter/multiplier 902.1 has multiplier input nodes 906.1 and 908.1 to receive multiplier input signals V1.1 and V2.1, multiplier output nodes 914.1 and 924.1 to provide output currents I1.1 and I3.1, and a weighting node 915.1 to receive a weighting factor W1. As another example, V-I converter/multiplier 902.M has multiplier input nodes 906.M and 908.M to receive multiplier input signals V1.M and V2.M, multiplier output nodes 914.M and 924.M to provide output currents I1.M and I3.M, and a weighting node 915.M to receive a weighting factor WM.

Summing circuit 901 includes a differential active cascode current mirror 903, summing nodes 914 and 924, and output nodes 916 and 926. Nodes 914 and 924 receive currents I1 and I3, differential active cascode current mirror 903 mirrors I1 and I3 to nodes 916 and 926 as I2 and I4. Node 914 connects to nodes 914.1 through 914.M. Node 924 connects to nodes 924.1 through 924.M. Summing circuit 901 sums currents I1.1 through I1.M to produce I1 at node 914. Thus, I1 equals the sum of I1.1 through I1.M. Summing circuit 901 sums currents I3.1 through I3.M to produce I3 at node 924. Thus, I3 equals the sum of I3.1 through I3.M.

Each of the V-I converter/multipliers 902.1 through 902.M can be any multiplier known to those skilled in the art. For example, each of the V-I converter/multipliers 902.1 through 902.M can be a typical four-quadrant multiplier, or other kind of V-I converter/multiplier, in which the V-I converter/multiplier multiplies its corresponding input voltages with a weighting factor to produce the corresponding output currents, where the corresponding output currents are proportional to the product of the input voltages and the weighting factor. For example, V-I converter/multiplier 902.1 can be a V-I converter/multiplier that multiplies V1.1 and V2.1 with W1 to produce I1.1 and I3.1, where I1.1 and I3.1 are proportional to the product of V1.1, V2.1, and W1.

In embodiments represented by FIG. 9, each of the weighting factors W1 through WM can be constant or variable. Each of the weighting factors W1 through WM can be an analog voltage or a digital word. Any V-I converter/multiplier capable of multiplying an input voltage and producing an output current can be used in alternate embodiments of the present invention.

Summing circuit 901 is similar to and operates in a similar fashion as summing circuit 701 (FIG. 7) and summing circuit 801 (FIG. 8). Currents I1.1 through I1.M correspond to currents I1.1 through I1.M (FIGS. 7–8). Currents I3.1 through I3.M corresponds to currents I3.1 through I3.M (FIG. 1). Nodes 914 and 924 are similar to nodes 714 and 724 (FIGS. 7 and 8), in which currents I1 and I3 represent similar currents among FIGS. 7–9. Differential active cascode current mirror 903 is similar to differential active cascode current mirrors 703 and 803 (FIGS. 7–8). Nodes 916 and 926 are similar to nodes 716 and 726 (FIGS. 7 and 8), in which 12 and 14 present similar currents among FIGS. 7–9.

Functional unit 900 can be a part of a signal filter such as a finite impulse response (FIR) filter, an equalizer, or other device that receives one or more signals and performs multiplication, or addition, or both to the signals. In some embodiments, functional unit 900 performs the multiplication and addition to signals received at a receiver to restore the signals to their original form, when the signals are distorted during transmission.

Figure 10:
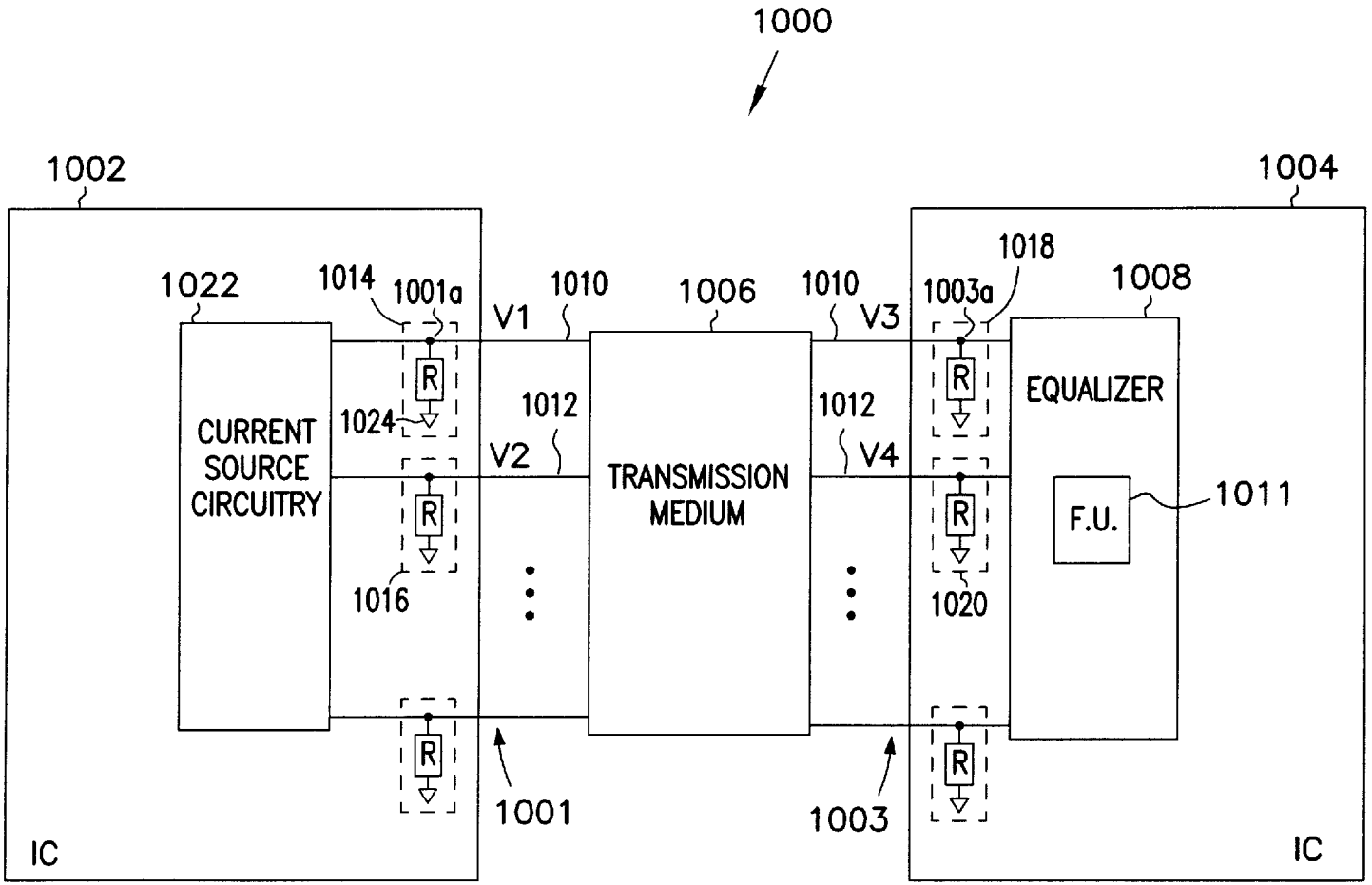
FIG. 10 shows a system.

FIG. 10 shows a system. System 1000 includes an integrated circuit (IC) 1002, an IC 1004, and a transmission medium 1006 connected between ICs 1002 and 1004 for data communication between IC 1002 and IC 1004. In some embodiments, transmission medium 1006 connects to IC 1002 at nodes 1001 and IC 1004 at nodes 1003. IC 1004 includes an equalizer 1008. Equalizer 1008 includes a functional unit (F.U.) 1011. Functional unit 1011 represents functional unit 900 (FIG. 9). In embodiments represented by FIG. 10, IC 1002 represents a transmitter to transmit a plurality of signals to IC 1004, which represents a receiver.

In some embodiments, transmission medium 1006 is a point-to-point transmission medium having a plurality of transmission lines such as transmission lines 1010 and 1012. Each of the transmission lines connects to a termination impedance of IC 1002 and a termination impedance of IC 1004. For example, transmission lines 1010 and 1012 connect to termination impedances 1014 and 1016 of IC 1002, and connect to termination impedances 1018 and 1020 of IC 1004. Each of the termination impedances includes a resistive element (R) connected to the corresponding transmission line and a supply node. A resistive element of IC 1002 connects to the corresponding transmission line at a driver node. A resistive element of IC 1004 connects to the corresponding transmission line at a receiver node. For example, the resistive element of termination impedance 1014 connects to transmission line 1010 at driver node

1001*a*. The resistive element of termination impedance 1018 connects to transmission line 1010 at receiver node 1003*a*. Each of the resistive elements connects to supply node 1024. In some embodiments, supply node 1024 connects to ground. In other embodiments, supply node 1024 connects to a non-zero voltage.

IC 1002 includes a current source circuitry 1022 to source a driver current onto each of the transmission lines. A portion of the driver current develops a voltage at the driver node. Another portion of the driver current travels on the transmission medium and develops a voltage at the receiver node. V1, V2, V3, and V4 indicate the voltages developed at the driver nodes of IC 1002 and at the receiver nodes of IC 1004.

In some embodiments, equalizer 1008 samples V3 and V4 to produce a plurality of sampled signals. For example, equalizer 1008 samples V3 to produce sampled signals such as the V1.1 through V1.M signals (FIG. 9), and samples V4 to produce sampled signals such as the V2.1 through V2.M signals (FIG. 9). During a signal processing operation, equalizer 1008 performs multiplication and addition to V1.1 through V1.M and V2.1 through V2.M to restore the original form of the V1 and V2 signals, when they are distorted during transmission from IC 1002 to IC 1004.

IC 1002 and IC 1004 can be any type of integrated circuit. For example, IC 1002 or IC 1004 can be a processor such as a microprocessor, a digital signal processor, a microcontroller, or the like. IC 1002 and IC 1004 can also be an integrated circuit other than a processor such as an application-specific integrated circuit, a communications device, a memory controller, or a memory such as a dynamic random access memory.

System 1000 can be of any type. Examples of system 1000 include computers (e.g., desktops, laptops, handhelds, servers, Web appliances, routers, etc.), wireless communications devices (e.g., cellular phones, cordless phones, pagers, personal digital assistants, etc.), computer-related peripherals (e.g., printers, scanners, monitors, etc.), entertainment devices (e.g., televisions, radios, stereos, tape and compact disc players, video cassette recorders, camcorders, digital cameras, MP3 (Motion Picture Experts Group, Audio Layer 3) players, video games, watches, etc.), and the like.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. Therefore, it is intended that this invention be limited only by the claims and the equivalents thereof.

What is claimed is:

1. A circuit comprising:

a first transistor; and a second transistor connected to the first transistor to form a first active cascode pair of transistors connected source-to-drain to form a first source-drain junction to receive a first input current to produce a first output current at source of one of the first and second transistors.

2. The circuit of claim 1, wherein a channel width to channel length ratio of the first transistor is unequal to a channel width to channel length ratio of the second transistor.

3. The circuit of claim 2 wherein the first and second transistors include gates connected to a bias node to receive a bias voltage.

4. The circuit of claim 3 further comprising a first load connected in series with a current path through the first active cascode pair of transistors.

5. The circuit of claim 1 further comprising:

a third transistor; and a fourth transistor connected to the first transistor to form a second active cascode pair of transistors connected to the first active cascode pair of transistors, the second active cascode pair of transistors connected source-to-drain to form a second source-drain junction to receive a second input current to produce a second output current at source of one of the third and fourth transistors.

6. The circuit of claim 5, wherein the first and second active cascode pairs of transistors connect to a bias node to receive a bias voltage.

7. The circuit of claim 6 further comprising:

a first load connected to the first active cascode pair of transistors; and a second load connected to the second active cascode pair of transistors.

8. The integrated circuit of claim 7, wherein one of the first and second loads includes a diode-connected transistor connected in series with one of the first and second active cascode pairs of transistors.

9. The integrated circuit of claim 6, wherein one of the first and second loads includes a diode-connected current mirror connected in series with one of the first and second active cascode pairs of transistors.

10. The integrated circuit of claim 5 further comprising a plurality of input current paths connected to the first source-drain junction, and another plurality of input current paths connected to the second source-drain junction.

11. The circuit of claim 5, wherein the first and second active cascode pairs of transistors connected to a first bias node to receive a first bias voltage and a second bias node to receive a second bias voltage.

12. A circuit comprising:

a first branch; and a second branch connected in parallel with the first branch, each of the first and second branches including an active cascode current mirror having a source-drain junction to receive an input current.

13. The circuit of claim 12, wherein the active cascode current mirror includes a first transistor connected to a second transistor, the first and second transistors having unequal channel width to channel length ratios.

14. The circuit of claim 13, wherein each of the first and second branches further includes a load connected to the active cascode current mirror.

15. The circuit of claim 13 further comprising a plurality of input current paths connected to the source-drain junction of the active cascode current mirror of the first branch, and another plurality of input current paths connected to the source-drain junction of the active cascode current mirror of the second branch.

16. The circuit of claim 15 further comprising a bias unit connected to a common gate of the first and second transistors.

17. The circuit of claim 15 further comprising:

a first bias unit connected to a gate the first transistor of the active cascode current mirror of each of the first and second branches; and a second bias unit connected to a gate the second transistor of the active cascode current mirror of each of the first and second branches.

18. A circuit comprising:

a first load connected between a first supply node and a first output node;

a second load connected between the first supply node and a second output node;

a first mirrored transistor including a drain connected to the first output node, a source connected to a first summing node, and a gate connected to a bias node;

a second mirrored transistor including a drain connected to the second output node, a source connected to a second summing node, and a gate connected to the bias node;

a first input transistor including a drain connected to the first summing node, a source connected to a second supply node, and a gate connected to the bias node; and a second input transistor including a drain connected to the second summing node, a source connected to the second supply node, and a gate connected to the bias node.

19. The circuit of claim 18, wherein one of the first and second loads includes a load transistor having a drain and a gate connected to the first supply node, and a source connected to one of the first and second output nodes.

20. The circuit of claim 18, wherein one of the first and second loads includes a diode-connected current mirror connected between the first supply node and one of the first and second output nodes.

21. The circuit of claim 18, wherein a channel width to channel length ratio of the first mirrored transistor is greater than a channel width to channel length ratio of the first input transistor.

22. The circuit of claim 21, wherein a channel width to channel length ratio of the second mirrored transistor is greater than a channel width to channel length ratio of the second input transistor.

23. The circuit of claim 18, wherein the first mirrored transistor is configure to have a greater threshold voltage than the first input transistor.

24. The circuit of claim 23, wherein the second mirrored transistor is configured to have a greater threshold voltage than the second input transistor.

25. An integrated circuit comprising:

a plurality of voltage-to-current converter/multipliers having multiplier input nodes to receive multiplier input signals, and multiplier output nodes to provide output currents; and a summing circuit connected to the voltage-to-current converter/multipliers, the summing circuit including:

a plurality of summing nodes connected to the multiplier output nodes; and a differential active cascode current mirror including a plurality of active cascode current mirrors, each including a source-drain junction connected to one of the summing nodes.

26. The integrated circuit of claim 25, wherein each of the active cascode current mirrors includes:

a first transistor including a source connected to a first supply node, a drain connected to one of the summing nodes, and a gate connected to a bias node; and a second transistor including a source connected to the same summing node as the first transistor, a drain connected to an output node, and a gate connected to the bias node.

27. The integrated circuit of claim 26, wherein a channel width to channel length ratio of the first transistor is unequal to a channel width to channel length ratio of the second transistor.

28. The integrated circuit of claim 25, wherein the summing circuit further including a plurality of loads, each including a load transistor connected to one of the active cascode current mirrors.

29. The integrated circuit of claim 25, wherein the summing circuit further including a plurality of loads, each including a current mirror connected to one of the active cascode current mirrors.

30. The integrated circuit of claim 28 further comprising a plurality of nodes to receive a plurality of input signals to produce the multiplier input signals.

31. A system comprising:

a transmitter;

a point-to-point transmission medium connected to the transmitter to transmit a plurality of transmitted signals; and a receiver connected to the point-to-point transmission medium to receive the transmitted signals and produce a plurality of sampled signals, the receiver including:

a plurality of voltage-to-current converter/multipliers having multiplier input nodes to receive the sampled signals, and multiplier output nodes to provide output currents; and a summing circuit including a differential active cascode current mirror connected the multiplier output nodes.

* * * * *